US008608263B2

(12) United States Patent
Eveland et al.

(10) Patent No.: US 8,608,263 B2
(45) Date of Patent: Dec. 17, 2013

(54) BEVERAGE CONTAINER STORAGE AND DISPENSING COMPARTMENT FOR A REFRIGERATOR

(75) Inventors: Michael J. Eveland, Cedar Rapids, IA (US); Russ B. Peter, Grinnell, IA (US); Dennis E. Winders, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 2312 days.

(21) Appl. No.: 11/329,203

(22) Filed: Jan. 11, 2006

(65) Prior Publication Data

US 2007/0157655 A1 Jul. 12, 2007

(51) Int. Cl.
*A47B 96/04* (2006.01)

(52) U.S. Cl.
USPC ..... 312/405.1

(58) Field of Classification Search
USPC ..... 312/405.1, 45, 72, 73, 35, 36, 321.5, 312/324, 326, 329, 293.1, 293.2, 116; 221/67, 175, 176; 211/59.2
See application file for complete search history.

(56) References Cited

U.S. PATENT DOCUMENTS

| | | | | | |
|---|---|---|---|---|---|
| 348,164 | A * | 8/1886 | Judson | 312/45 |
| 2,136,089 | A | 11/1938 | Stone | |
| 2,852,327 | A | 9/1958 | Mason | |
| 2,888,145 | A | 5/1959 | Knott et al. | |
| 2,996,344 | A | 8/1961 | Garman | |
| 3,298,763 | A | 1/1967 | Domenico | |
| 3,379,294 | A | 4/1968 | Liew, Jr. | |
| 3,552,817 | A * | 1/1971 | Marcolongo | 312/107 |
| 3,580,439 | A * | 5/1971 | Jewett et al. | 224/328 |
| 3,805,964 | A | 4/1974 | Titus, Jr. | |
| 4,287,992 | A | 9/1981 | Takemori | |
| 4,586,633 | A * | 5/1986 | Holland et al. | 221/257 |
| 4,852,767 | A * | 8/1989 | Humphrey | 221/241 |
| 4,911,309 | A | 3/1990 | Stefan | |
| 4,921,315 | A * | 5/1990 | Metcalfe et al. | 312/321.5 |
| 5,009,329 | A | 4/1991 | Farrentine | |
| 5,078,459 | A | 1/1992 | Sclater | |
| 5,356,033 | A | 10/1994 | Delaney | |
| 5,462,198 | A | 10/1995 | Schwimmer | |
| 6,085,542 | A | 7/2000 | Johnson et al. | |
| 6,173,582 | B1 | 1/2001 | Hixson | |
| 6,206,237 | B1 | 3/2001 | Dillon et al. | |
| 6,694,770 | B2 * | 2/2004 | Winders et al. | 62/440 |
| 6,694,771 | B2 | 2/2004 | Kim et al. | |

* cited by examiner

*Primary Examiner* — Matthew Ing

(57) ABSTRACT

A storage/dispensing compartment includes a front wall portion, a rear wall portion, a bottom wall portion and opposing side wall portions that collectively define a storage zone. The storage/dispensing compartment further includes a mounting element that is arranged on an underside of the bottom wall portion. The mounting element cooperates with a mounting member to position and secure the storage compartment in a storage cavity of a chiller compartment arranged on a refrigerator door. The storage/dispensing compartment, constructed in accordance with one embodiment, includes first and second, laterally arranged storage zones, each having respective inlet and outlet portions and a plurality of divider walls. The divider walls establish a serpentine path that extends from the inlet portion to the outlet portion.

15 Claims, 5 Drawing Sheets

BEVERAGE CONTAINER STORAGE AND DISPENSING COMPARTMENT FOR A REFRIGERATOR

BACKGROUND OF THE INVENTION

1. Field of the Invention

The present invention pertains to the art of refrigerators and, more particularly, to a storage and dispensing compartment arranged in a refrigerator door for holding beverage containers.

2. Discussion of the Prior Art

In a refrigerator, it is highly desirable to enhance the ability to store products within a limited space. The space available for storage not only includes fresh food and freezer compartments, but also inner surfaces of the fresh food and freezer compartment doors of the refrigerator. Towards this end, it is common to provide shelves and compartments on these inner surfaces. In recent years, some emphasis has been placed on increasing the ability to store a wide range of products on the fresh food door in order to free up space in the main areas of the refrigerator for additional products or features. Thus, provisions have been made to store large beverage containers, including gallon milk jugs and liter bottles of soda on the fresh food compartment door.

There is also a recognized need to provide a reduced temperature storage compartment for beverages and the like. In order to address this need, several refrigerator models are provided with specialized chill compartments. The chill compartment is typically arranged on the fresh food compartment door and is provided with a door or cover for selectively accessing the compartment. To provide for a reduced temperature in the chill compartment, a flow of cooling air is guided from the freezer compartment into the chill compartment. Consumers can place items into the chill compartment, such as soda bottles, wine bottles and the like, that they wish to be cooled to a temperature below a temperature of the fresh food compartment.

While the chiller compartment is capable of storing all kinds of containers, it is hardly practical to store small containers such as beverage cans. The number of cans that can be placed in the compartment is limited. The cans cannot be stacked for fear that opening the refrigerator would cause the cans to topple from the compartment. Arranging the cans in a typical can holder would also not be acceptable. Unless the can holder was properly constrained, it too could become dislodged and fall from the refrigerator with the opening of the fresh food door.

Based on the above, despite the presence of chiller compartments in the prior art, there exists a need in the art for a chiller compartment that includes a beverage can holder. More specifically, there exists a need for a chiller compartment having a beverage can holder that can be securely, yet removably, mounted to a refrigerator door.

SUMMARY OF THE INVENTION

The present invention is directed to a beverage container storage and dispensing compartment that can be mounted in a refrigerator door. More specifically, the present invention is directed to a removable storage/dispensing compartment that can be securely arranged in a chiller compartment provided on an inner liner of a fresh food compartment door of a refrigerator. The chiller compartment includes top, bottom, rear and opposing side walls that collectively define a storage cavity. A mounting member for securing the storage/dispensing compartment in the chiller compartment is provided on the bottom wall of the storage cavity. The chiller compartment is also provided with a door that selectively closes off the storage cavity to allow an air flow from a freezer compartment to treat articles contained therein.

In accordance with the invention, the storage/dispensing compartment includes a front wall portion, a rear wall portion, a bottom wall portion and opposing side wall portions that collectively define a storage zone. The storage/dispensing compartment further includes a mounting element that is arranged on an underside of the bottom wall portion. The mounting element cooperates with the mounting member to position and secure the storage compartment in the storage cavity of the chiller compartment.

In accordance with the most preferred form of the invention, the storage/dispensing compartment includes first and second, laterally arranged storage zones, each having a respective inlet portion and an outlet portion. In addition, each of the first and second storage zones is provided with a plurality of divider walls that project outward from the front and rear wall portions into the first and second storage zones respectively. The divider walls establish a serpentine path that extends from the inlet portion to the outlet portion. The presence and orientation of the divider walls guide beverage cans from the inlet to the outlet. In addition, the divider walls advantageously increase the overall capacity of the storage/dispensing compartment.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
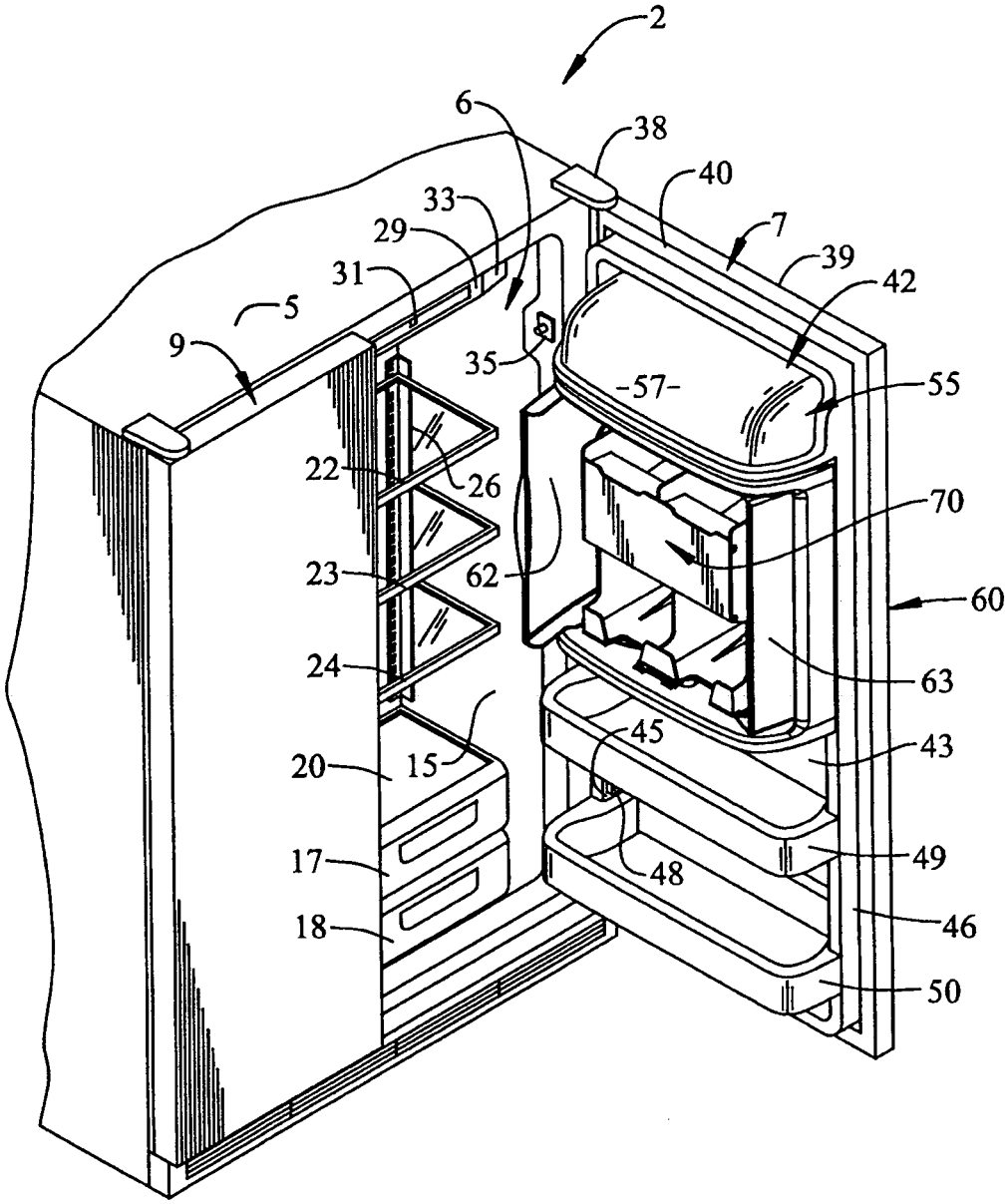
FIG. 1 is an upper left perspective view of a refrigerator including a storage and dispensing compartment for beverage containers mounted in a chiller compartment in accordance with the present invention.

With initial reference to FIG. 1, a side-by-side refrigerator, generally indicated at 2, includes a cabinet shell 5 within which is defined a fresh food compartment 6 provided with a fresh food compartment door 7 and a freezer compartment (not shown) which can be accessed through a freezer compartment door 9. In a manner known in the art, fresh food compartment 6 is separated from the freezer compartment by means of a partition (also not shown). For the sake of completeness, fresh food compartment 6 includes a liner 15 within which is positioned a pair of lower, slidable storage bins 17 and 18 that are arranged below a fixed shelf 20. Above shelf 20 is shown three cantilevered, vertically adjustable shelves 22-24 that are mounted upon shelf support rails, one of which is indicated at 26. At a top portion of liner 15 is mounted a temperature control housing or user interface 29 shown to include at least one manual control knob 31 for use in selectively setting temperatures within refrigerator 2. Temperature control housing 29 also has associated therewith laterally spaced light housings, one of which is indicated at 33, for illuminating fresh food compartment 6 depending upon the position of a door activated switch 35. Again, this structure is being described for the sake of completeness and does not actually form part of the present invention. Instead, the structure is common in the art and therefore will not be discussed further herein.

Fresh food compartment door 7 is mounted for pivotal movement about a substantially vertical axis defined by an upper hinge 38 and a lower hinge (not shown). Fresh food compartment door 7 has an outer shell portion 39 and an inner wall portion 40 upon which is provided a refrigerated product storage system 42. More specifically, inner wall portion 40 has secured thereto a molded liner 43 which defines a pair of laterally spaced, dike portions 45 and 46. Each dike portion 45, 46 is preferably formed with a plurality of inwardly projecting, molded rails 48 upon which can be removably supported product storage shelves, trays or bins, such as bucket-type bins 49 and 50. As will be detailed more fully below, storage system 42 generally includes an upper dairy compartment 55 that is preferably provided with a clear plastic compartment cover 57, and a chill compartment 60 provided with chill compartment doors 62 and 63. In accordance with the invention, chill compartment 60 houses a storage/dispensing compartment 70.

Figure 2:
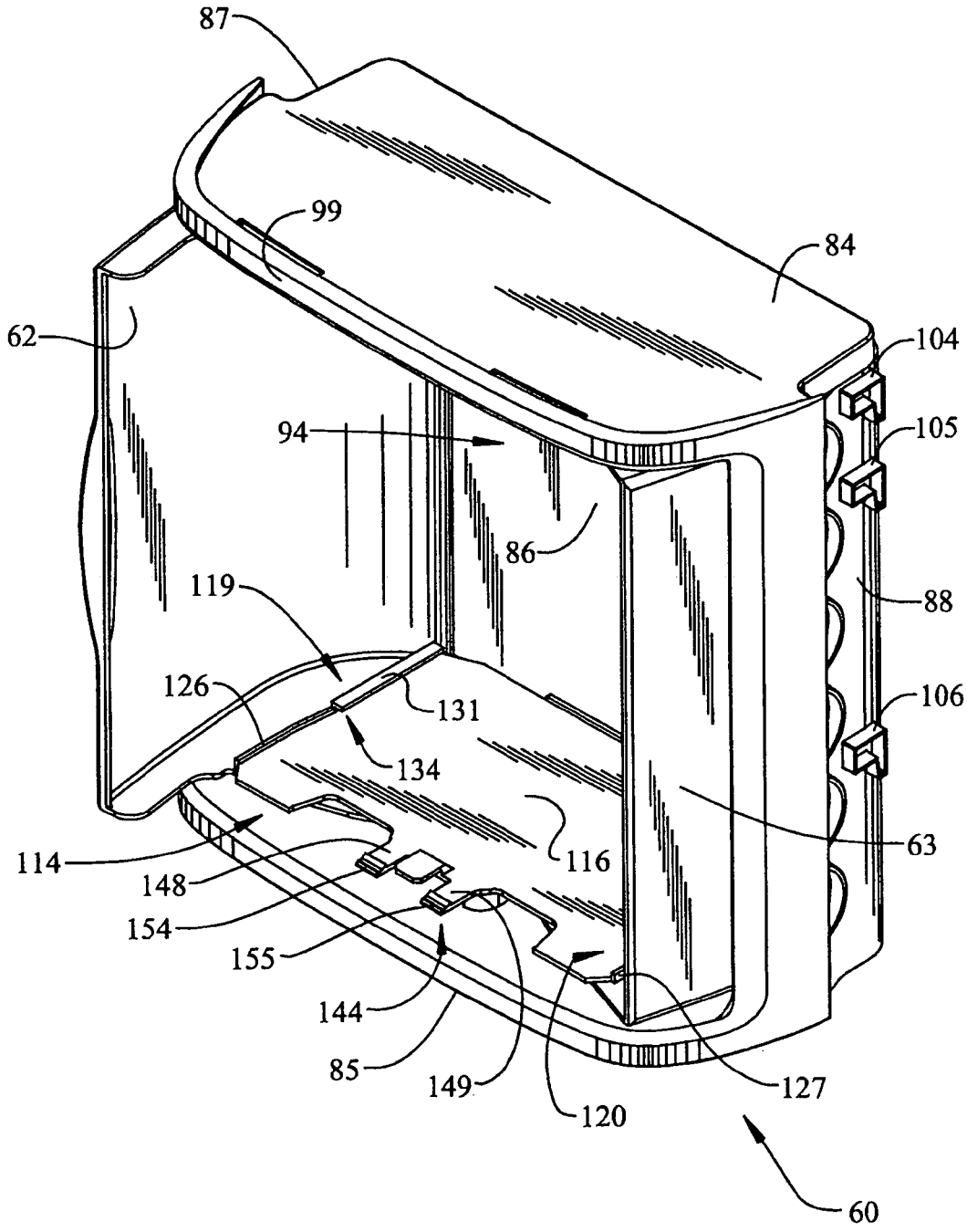
FIG. 2 is an upper right perspective view of the chiller compartment of FIG. 1.

Referring to FIG. 2, chill compartment 60 includes top, bottom, rear and opposing side walls 84-88 that collectively define a storage cavity 94. Chill compartment 60 also includes a face frame 99 that retains and guides chill compartment doors 62 and 63 between an open position, in which storage cavity 94 is exposed and a closed position, wherein storage cavity 94 is covered. In the embodiment shown, chill compartment 60 is detachably mounted to molded liner 43. Towards that end, each opposing side portion 87 and 88 is provided with a plurality of lug elements such as indicated at 104-106. In addition, a duct (not shown) leads cooling air from the freezer compartment into storage cavity 94.

In accordance with the invention, chill compartment 60 includes a mounting member 114 that, as will be discussed more fully below, supports and positions storage/dispensing compartment 70 within storage cavity 94. Mounting member 114 includes a support platform 116 that is spaced from bottom wall 85. Support platform 116 includes first and second side edge portions 119 and 120, each having a corresponding upstanding wall portion 126, 127 that define a respective guide rail. In further accordance with the invention, a section of each upstanding wall portion 126, 127 includes an in-turned wall portion 131, 132 that establish corresponding guide channels, one of which is indicated at 134.

In further accordance with the invention, mounting member 114 includes a locking member 144 having first and second projection elements 148 and 149 which, in a manner that will be discussed more fully below, cooperate with guide channel 134 to retain storage/dispensing compartment 70 within storage cavity 94. To this end, each projection element 148, 149 is provided with an associated tab element 154, 155 that engages storage/dispensing compartment 70.

Figure 3:
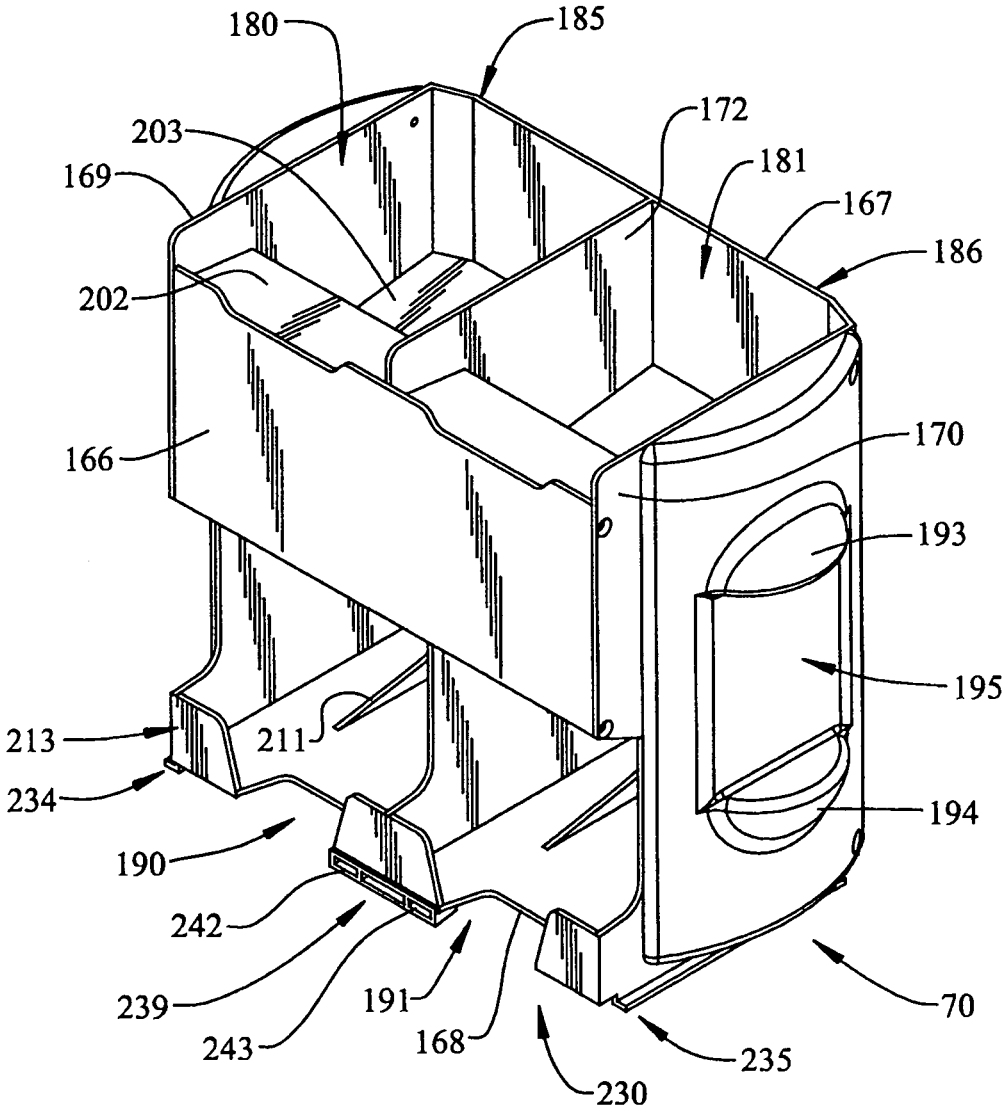
FIG. 3 is an upper right perspective view of the storage and dispensing compartment constructed in accordance with a first embodiment of the present invention.
Figure 4:
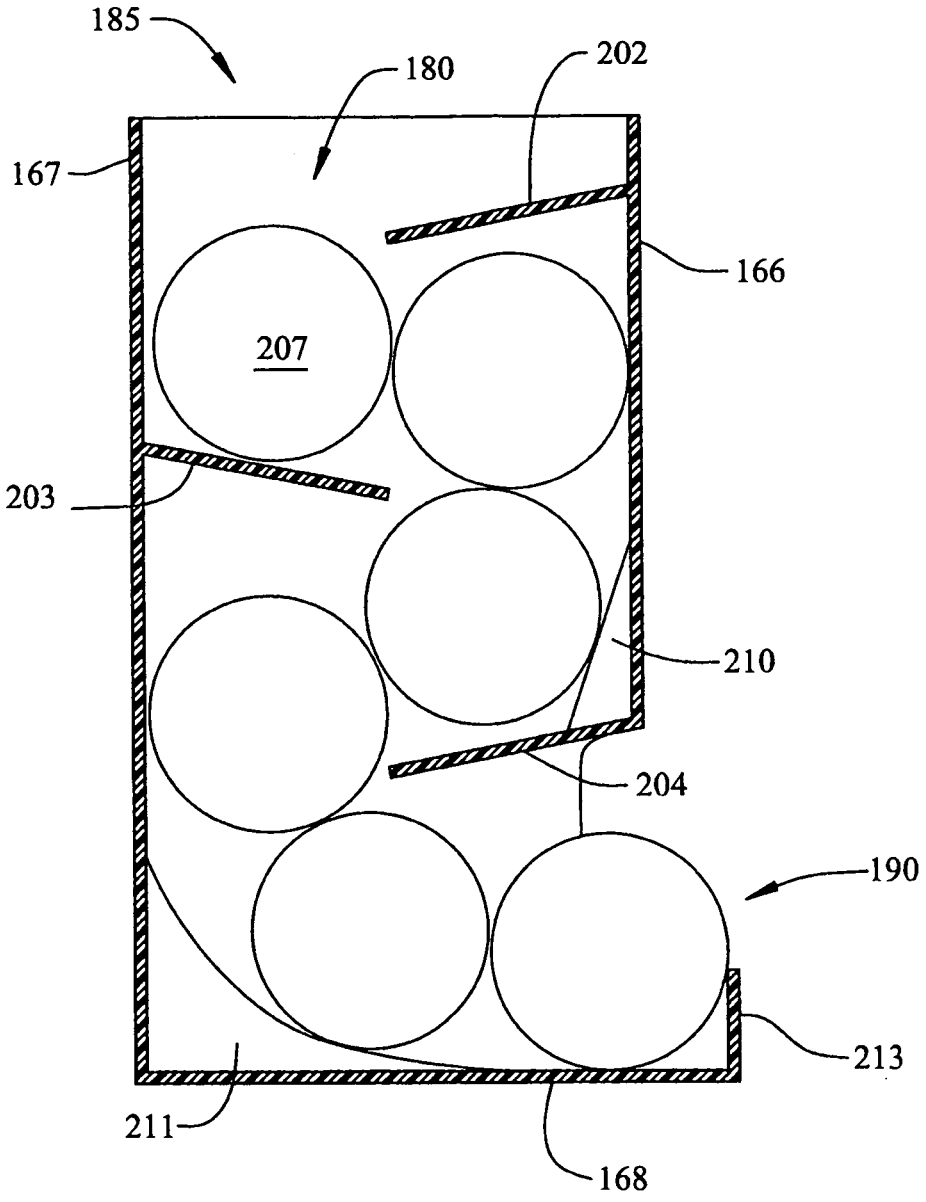
FIG. 4 is a cross-sectional side view of the storage and dispensing compartment of FIG. 3.

Reference will now be made to FIGS. 3 and 4 in describing the particular structure of storage/dispensing compartment 70. As shown, storage/dispensing compartment 70 includes front, rear, bottom and opposing side wall portions 166-170, as well as a partition wall 172. Partition wall 172 extends between front and rear wall portions 166 and 167 effectively dividing storage/dispensing compartment 70 to establish first and second product storage zones 180 and 181. As shown, each product storage zone 180, 181 includes a corresponding inlet portion 185, 186 that leads to a respective outlet portion 190, 191. Additionally, each opposing side wall portion 169, 170 is provided with a pair of raised regions 193 and 194 (shown with respect to side wall portion 170) that define a gripping zone 195 in order to enable a consumer to readily grasp and remove storage/dispensing compartment 70 from storage cavity 94. In any case, as each product storage zone 180, 181 is identical, a detailed description will be made with respect to storage zone 180 with an understanding that storage zone 181 includes similar structure.

As best shown in FIG. 4, storage zone 180 includes a plurality of divider walls 202-204 that project from outward front and rear wall portions 166 and 167 into storage zone 180. More specifically, divider walls 202-204 are staggered and project at a downward angle from front and rear wall portions 166 and 167 so as to establish a serpentine path between inlet portion 185 and outlet portion 190. Divider walls 202-204 guide beverage containers, such as cans 207, from inlet portion 185 to outlet portion 190. Storage zone 180 is also provided with a series of ramps such as indicated at 210 and 211. With this arrangement, cans 207 that are loaded into inlet portion 185 progress along the serpentine path defined by divider walls 202-204 and are urged towards outlet portion 190 along ramps 210 and 211. However, in order to ensure cans 207 do not inadvertently egress from storage zone 180, storage/dispensing compartment 70 is provided with a forward stop wall 213.

In accordance with the most referred form of the invention, storage/dispensing compartment 70 is detachably mounted within storage cavity 94 through mounting member 114. That is, storage/dispensing compartment 70 is provided with a mounting element 230 (see FIG. 3) that cooperates with mounting member 114 to position and retain storage/dispensing compartment 70 in chill compartment 60. As best shown in FIG. 3, mounting element 230 includes first and second guide rails 234 and 235, as well as a locking element 239. Locking element 239 is provided with first and second channels 242 and 243 which, as will be discussed more fully below, cooperate with projection elements 148 and 149 and tab elements 154 and 155 to retain storage/dispensing compartment 70.

In order to be used, storage/dispensing compartment 70 is initially placed upon support platform 116, centered between upstanding wall portions 126 and 127. That is, first and second guide rails 234 and 235 are placed inward or inboard of upstanding wall portions 126 and 127. At this point storage/dispensing compartment 70 is shifted rearward into storage cavity 94 such that first and second guide rails 234 ad 235 engage with guide channel 134 while forward projections 148 and 149 become aligned with channels 242 and 243 respectively. A final shifting causes tab members 154 and 155 to deflect forward projections 148 and 149 downward and when fully seated, tab members 154 and 155 hook or catch upon locking element 239. To remove storage/dispensing compartment 70 from cavity 94, tab members 154 and 155 are simply deflected, allowing forward projections 148 and 149 to disengage from locking element 139. At this point, a consumer need merely grasp gripping zone 195 and shift storage/dispensing compartment 70 from chill compartment 60.

Based on the above, it should be understood that the storage/dispensing compartment of the present invention advantageously provides a consumer with the ability to store a rather large quantity of beverage containers in a chiller compartment arranged on a fresh food compartment door without fear that the containers will become dislodged and fall from the compartment. In addition, the mounting arrangement employed by the present invention enables a consumer to selectively remove the storage/dispensing compartment so as to employ the chiller compartment for other purposes.

Figure 5:
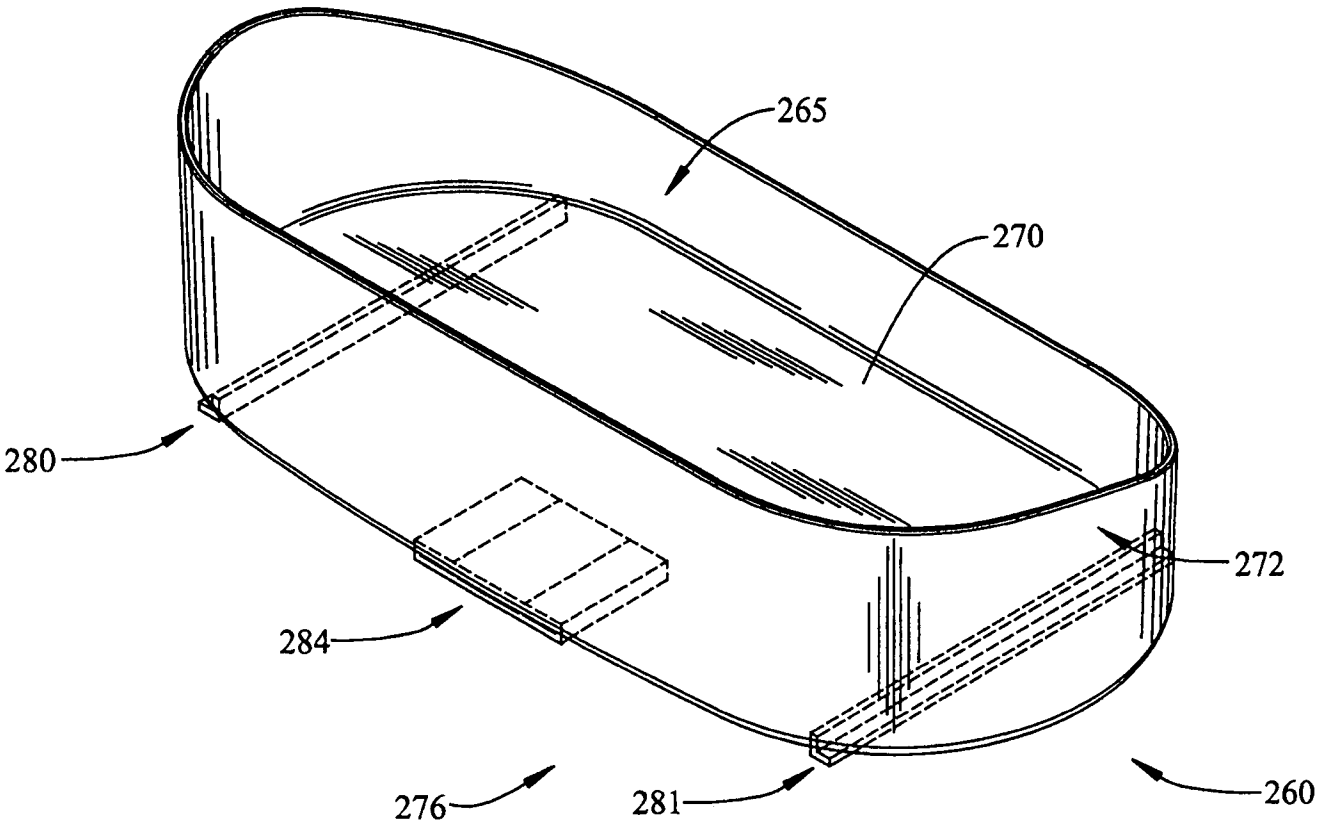
FIG. 5 is an upper right perspective view of a storage and dispensing compartment constructed in accordance with a second embodiment of the present invention.

Although described with reference to one preferred embodiment of the present invention, it should be readily understood that various changes and/or modifications can be made to the invention without departing from the spirit thereof. For instance, while the storage/dispensing compartment described is shown to include multiple storage zones, FIG. 5 depicts a storage/dispensing compartment 260 provided with a single storage zone 265. That is, storage compartment 260 can include a bottom wall 270, as well as a continuous, upstanding peripheral wall 272 that establishes a generally oval-shaped storage zone. Storage/dispensing compartment 260 is provided with a mounting element 276, similar to that described above, having guide rails 280 and 281, as well as a locking element 284 that enable the storage/dispensing compartment 260 to be detachably mounted within chill compartment 60 as an alternative to storage/dispensing compartment 70. Instead of defining a respective path for dispensing of beverage container, storage/dispensing compartment 260 establishes a shelf with an upstanding peripheral wall for supporting a variety of other types of containers. In any case, in general, the invention is only intended to be limited by the scope of the following claims.

We claim:

1. A refrigerator comprising:

a cabinet;

a liner arranged in the cabinet, said liner defining a fresh food compartment;

a door pivotally mounted relative to the cabinet, said door including an outer shell and an inner liner;

a chiller compartment arranged on the inner liner of the door, said chiller compartment including top, bottom, rear and side walls that collectively define a storage cavity, said bottom wall including a mounting member, wherein the mounting member includes a support platform, spaced from and attached to the bottom wall of the chiller compartment, said support platform including first and second opposing side edge portions and a locking member;

a chiller compartment door pivotally mounted relative to the chiller compartment, said chiller compartment door being shiftable between an open position wherein the storage cavity is exposed and a closed position wherein the storage cavity is covered; and a storage compartment, for retaining beverage containers, said storage compartment including a front wall portion, a rear wall portion, a bottom wall portion and opposing side wall portions that collectively define a storage area including an inlet portion and an outlet portion, a plurality of divider walls establishing a serpentine path extending from the inlet portion to the outlet portion and, a mounting element arranged on an underside of the bottom wall portion, said mounting element being adapted to interengage with the mounting member to detachably mount the storage compartment in the storage cavity of the chiller compartment.

2. The refrigerator according to claim 1, wherein the locking member includes a projection extending from the mounting member.

3. The refrigerator according to claim 2, wherein the mounting element includes first and second guide rails adapted to cooperate with the first and second opposing side edge portions and a locking element adapted to receive the projection.

4. The refrigerator according to claim 3, wherein the locking element includes a channel, said channel being adapted to receive the projection.

5. The refrigerator according to claim 4, wherein the projection includes a tab element, said tab element being adapted to engage the locking element.

6. The refrigerator according to claim 1, wherein the mounting member includes first and second forward projections and the locking element includes first and second channels, said first and second forward projections being received in the first and second channels respectively.

7. The refrigerator according to claim 1, wherein the mounting element includes first and second guide rails adapted to cooperate with the first and second opposing side edge portions and a locking element adapted to receive the locking member.

8. The refrigerator according to claim 1, wherein the chiller compartment includes a plurality of lug elements detachably supporting the chiller compartment on the liner.

9. The refrigerator according to claim 1, wherein the storage compartment includes a partition wall extending in the storage area between front and rear wall portions to establish first and second distinct storage zones adapted to retain a plurality of beverage cans.

10. The refrigerator according to claim 1, wherein said plurality of divider walls are vertically spaced and downwardly angled within the storage compartment.

11. A storage compartment for supporting beverage containers on a door of a refrigerator including a chiller compartment defining a storage cavity comprising:

a front wall portion, a rear wall portion a bottom wall portion and opposing side wall portions that collectively define a storage area including an inlet portion and an outlet portion, a plurality of divider walls establishing a serpentine path from said inlet portion to said outlet portion; and a mounting element arranged on an underside of the bottom wall portion, said mounting element being adapted to interengage with a mounting member of a chiller compartment arranged on a refrigerator door to detachably mount the storage compartment in a storage cavity of the chiller compartment.

12. The storage compartment according to claim 11, wherein the mounting element includes first and second guide rails and a locking element for retaining the storage compartment on a refrigerator door.

13. The storage compartment according to claim 11, wherein the storage compartment includes a partition wall extending in the storage area between front and rear wall portions to establish first and second distinct storage zones adapted to retain a plurality of beverage cans.

14. The storage compartment according to claim 13, wherein each of the first and second storage zones includes a ramp provided along the serpentine path to, in addition to the plurality of divider walls, guide a beverage container to the outlet portion.

15. The refrigerator according to claim 11, wherein said plurality of divider walls are vertically spaced and downwardly angled within the storage compartment.

* * * * *